United States Patent [19]

Stumpmeier

[11] 4,456,226

[45] Jun. 26, 1984

[54] TRACTION DEVICE

[76] Inventor: Fritz Stumpmeier, In den Birken 47, D-5600 Wuppertal, Fed. Rep. of Germany

[21] Appl. No.: 303,120

[22] Filed: Sep. 17, 1981

[30] Foreign Application Priority Data

Sep. 25, 1980 [DE] Fed. Rep. of Germany ..... 3036214

[51] Int. Cl.[3] ..... B65H 3/18

[52] U.S. Cl. ..... 254/264; 226/112; 226/115; 226/162; 254/228

[58] Field of Search ..... 254/264, 384, 228, 254, 254/259; 226/112, 115, 158, 162

[56] References Cited

U.S. PATENT DOCUMENTS

| | | | |
|---|---|---|---|
| 3,266,776 | 8/1966 | Catu | 254/264 |
| 3,474,946 | 10/1969 | Desplats et al. | 226/112 |
| 4,261,238 | 4/1981 | Scribner | 226/115 |

FOREIGN PATENT DOCUMENTS

| | | | |
|---|---|---|---|
| 795195 | 9/1968 | Canada | 254/264 |
| 2028851 | 12/1970 | Fed. Rep. of Germany | 226/162 |
| 1531334 | 5/1973 | Fed. Rep. of Germany . | |
| 1186244 | 4/1970 | United Kingdom | 254/264 |

*Primary Examiner*—John M. Jillions
*Attorney, Agent, or Firm*—Scully, Scott, Murphy & Presser

[57] ABSTRACT

A traction device for causing stepwise relative displacement between the device and an elongate member in the form of a cable (6) comprises a stationary clamp (5) and a movable clamp (3) which is displaced by a cylinder and piston unit (1, 2). Both clamps (3, 5) are self-closing, but are provided with pressure-operated opening devices (8, 9). The opening devices (8, 9) are controlled by a first control valve (12) which is changed over at the stroke ends of the piston (2) by dogs (13, 14). A second control valve (15) which controls the travel direction of the piston (2) is governed by the pressure medium fed to the opening devices (8, 9).

To lift a load suspended from the cable (6), the piston (2) is raised, with the movable clamp (3) closed to grip the cable and the stationary clamp (5) open. At the top of the piston stroke, the stationary clamp (5) closes, the movable clamp (3) opens, and the piston (2) falls to enable the movable clamp (3) to grip the cable (6) again at a lower position.

24 Claims, 6 Drawing Figures

TRACTION DEVICE

This invention relates to a traction device for causing step-wise relative displacement between the device and an elongate member such as a cable. The device may be used as a hoist for lifting and lowering loads.

German Auslegeschrift No. 15 31 334 discloses a traction device in which a pair of clamping jaws is displaced by a cylinder and piston unit, the jaws carrying two rods extending in the direction of travel of the jaws. Each rod has two stops for actuating limit switches, the stops of one rod and one limit switch determining the stroke length of the jaws when the cable is raised, while the stops of the other rod and the other limit switch determine the stroke length when the cable is lowered. Multi-way valves are controlled by the limit switches which, as a function of a selector switch, initiate in each case the reversal of the piston movement.

The pairs of clamping jaws may be switched alternately into their closed and open positions by a telescopic control rod having stops, which connects them together, and they may be fixed in the open position by a locking device comprising a spring-loaded pin.

German Auslegeschrift No. 11 33 098 discloses a stepwise traction device having a piston displaced in a cylinder, a pair of clamping jaws mounted on the piston rod so as to be reciprocated by it, and a fixed pair of clamping jaws mounted on the cylinder. Both pairs of clamping jaws are self-closing. The reversal of the piston stroke is effected automatically by hydraulic control members as a function of the piston stroke.

This device has, however, only one direction of pull and may therefore be used, for example, for pulling and lifting loads, for instance pulling up stakes, but not for moving loads, or allowing them to move, in the opposing direction as is required for lifting and lowering loads.

In fact, in a device for lifting and lowering loads it is not so much the lifting which presents problems if self-closing clamping jaws are used, as the lowering of the loads. During lowering, the pair of jaws moving in the direction of the load must remain locked, while the stationary pair of jaws must remain open. Particularly with heavier loads, the jaws, when closed, can require great force to open them, and for this reason mechanical control members, such as the known control rod, have to be of a very strong construction.

According to the present invention, there is provided a traction device for causing stepwise relative displacement between the device and an elongate member, the device comprising a stationary clamp and a movable clamp which is displaceable by a cylinder and piston unit relatively to the stationary clamp in the lengthwise direction of the elongate member, each clamp comprising a pair of self-closing jaws for engagement with the elongate member, a respective pressure-operated opening device being provided for each clamp for opening the jaws of the clamp to release the elongate member, the opening devices being controlled by a first control valve which supplies pressure medium alternately to one or the other of the opening devices, the state of the first control valve being governed by the cylinder and piston unit, the stroke direction of the cylinder and piston unit being controlled by a second control valve, the state of which is governed by pressure medium supplied to the opening devices.

With a traction device in accordance with the present invention, whichever clamp is unloaded at the time is opened, which means that, in succession, the load is transferred firstly to the opening device and then the direction of movement of the piston is reversed by the control pulse which operates the opening device and by the control sequence preset in the structure of the control valves.

This facilitates the opening of the clamps. Also, the control rod for opening and closing the clamps becomes unnecessary.

Preferred features of the present invention provide, inter alia, protection against an insecure grip, and a constant lowering rate of the load.

For a better understanding of the present invention, and to show how it may be carried into effect, reference will now be made, by way of example, to the accompanying drawings, in which.

The traction devices shown in the Figures are represented as hoists acting on cables for lifting and lowering loads. It will be appreciated, however, that devices in accordance with the present invention can be used to apply forces to elongate members other than cables and in directions other than vertical.

Figure 1:
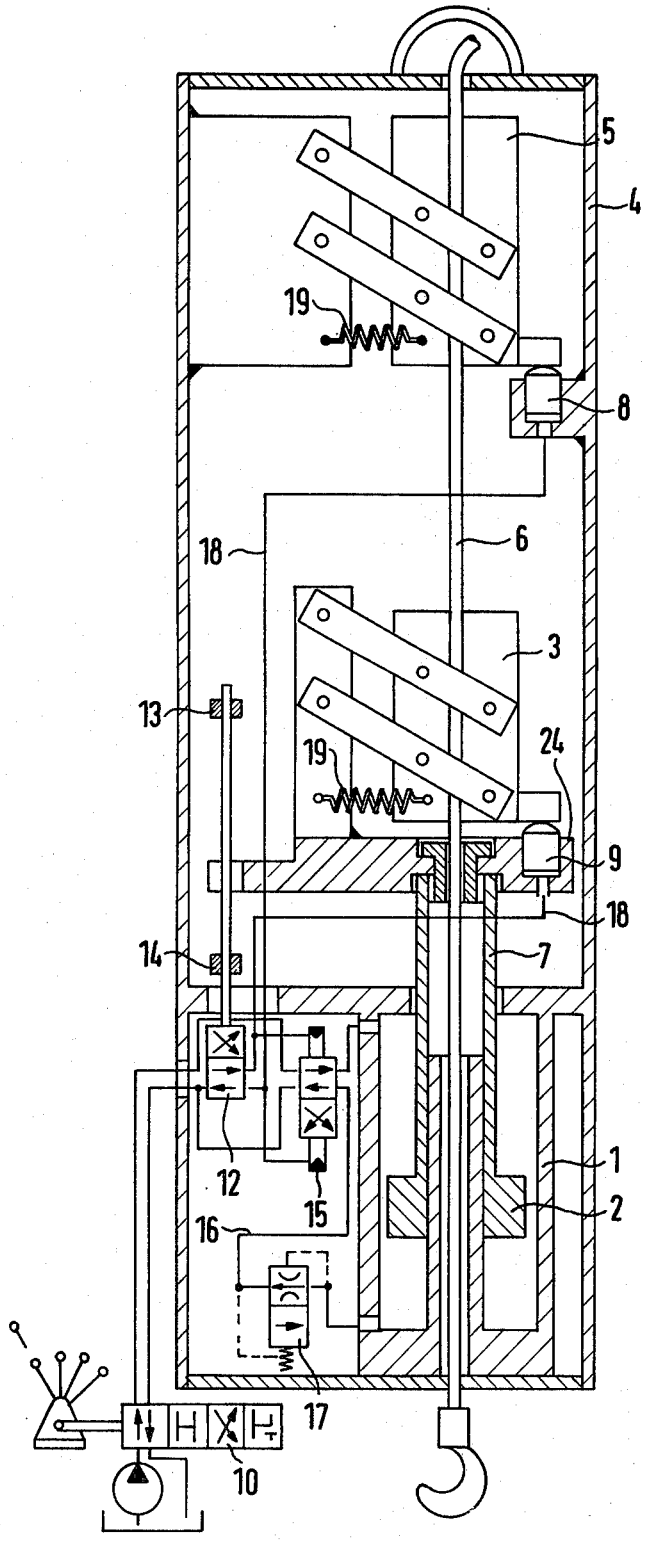
FIG. 1 shows one embodiment of a traction device.

The hoist shown in FIG. 1 comprises a hydraulic cylinder 1 in which a piston 2 is movable. A piston rod 7 is fixed to the piston 2 and a bore extends axially through the piston rod 7 and the piston 2. A movable clamp 3 is mounted on the piston rod 7. A stationary clamp 5 is mounted on a housing 4 located in an extension of the cylinder 1. The clamps 3 and 5 comprise self-closing jaws. A cable 6 runs between the jaws of the clamps 3 and 5. Pressure medium can act on both sides of the piston 2, and the piston/cylinder unit 1, 2 is thus double-acting.

The stationary clamp 5 is provided with an opening device constituted by a plunger 8 and the movable clamp 3 with an opening device constituted by a plunger 9. The raising and lowering movements of the piston 2 are initiated by a hydraulic valve 10. As diagrammatically represented in FIG. 1, this valve 10 has, from left to right, a lift position, a central or neutral position, a lowering position and an opening position. The valve 10 is shown as a manually operated valve, but it may alternatively be operated magnetically.

The plungers 8, 9 are operated by a hydraulic directional control valve 12 which receives pressure medium from the valve 10 and is controlled as a function of the position of the piston 2. The valve 12 is reversed at the two end positions of the piston stroke by means of dogs 13 and 14 which co-operate with a yoke 24 on the free end of the piston rod 7. This reversal firstly changes over the states of the plungers 8 and 9 and secondly reverses a pressure operated hydraulic directional control valve 15. Depending on the state of the control circuitry, each end region of the interior of the cylinder 1 is connected either to a pump or to a reservoir.

There is a speed control valve 17 of known construction located in a connecting line 16 between the valve 15 and the cylinder 1. During lowering, the valve 17 opens to a flow cross-section which is a function of pressure, i.e. a function of the load, so producing a constant flowrate and thus a constant lowering speed.

Figure 3:
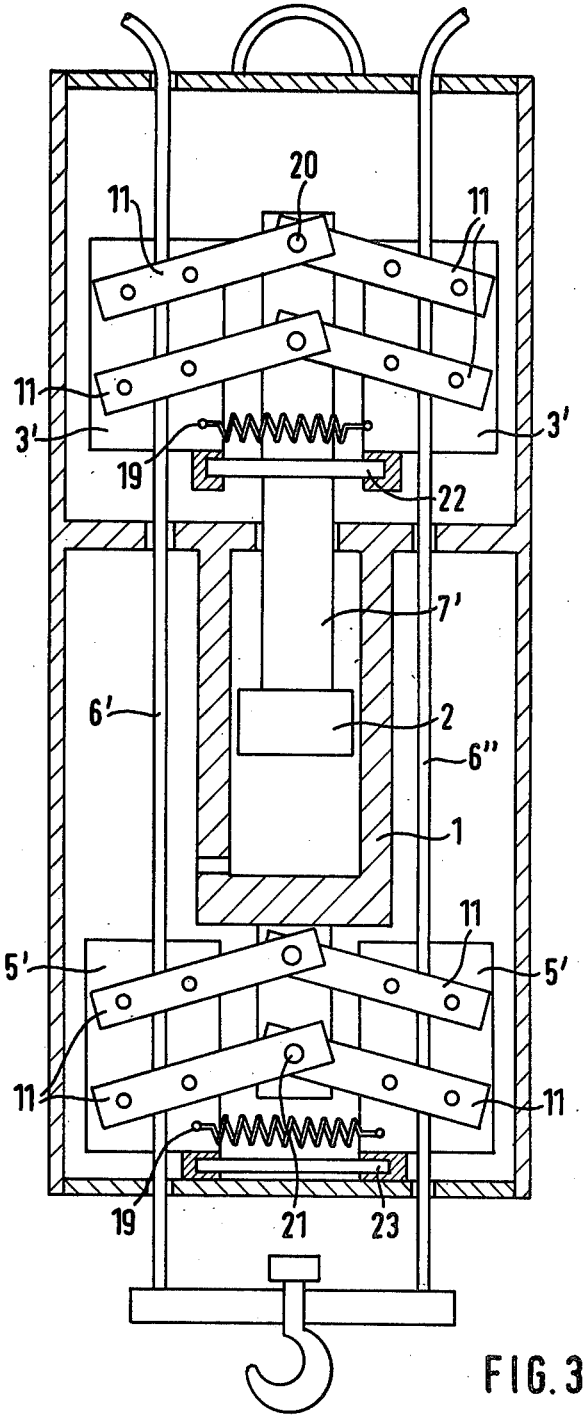
FIG. 3 shows a second embodiment of a traction device.

The embodiment represented in FIG. 1, in which the plunger 9 is located in the yoke 24, is of a particularly compact construction. In this connection the pressure medium has to be conducted to and from the plunger 9 through a flexible component, for example a hose 18 (merely shown diagrammatically as a line). As a general principle, it is also possible to have a stationary plunger mounted on the cylinder 1, which then of course has to be able to travel through the full stroke of the piston 2. The solution using the hose, shown in FIGS. 1 and 3, is therefore more advantageous and also cheaper. A structural arrangement where both clamps are arranged so that they lie one behind the other and the cylinder/piston arrangement is such that the larger piston surface is acted upon in the opposite direction to the direction of load is also of particular advantage.

Figure 2:
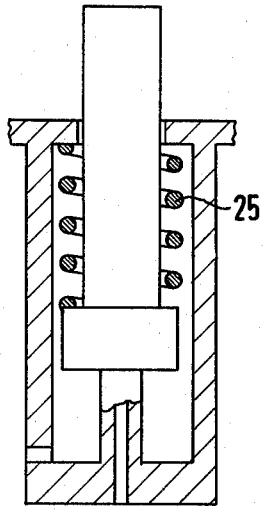
FIG. 2 shows a modification of the traction device of FIG. 1.

FIG. 2 shows an embodiment in which the piston/-cylinder unit is single-acting and the piston return stroke is effected by a spring 25.

FIG. 3 shows a different area cylinder having two moving clamps 3' and two stationary clamps 5'. The stationary and moving clamps each have a common bearing 20 and 21 on the central axis of the cylinder and piston unit. This arrangement operates with two cables 6' and 6'' in tandem. An arrangement of this kind is suitable for very heavy loads and again has the advantage that the larger piston surface is acted upon in the opposite direction to the direction of load as in the embodiment of FIG. 1. The tandem cable arrangement provides an additional safety factor provided that the dimensions of the components are such that a single clamp is capable of supporting the load. The springs 19 seen in FIGS. 1 and 3 and acting in each case on one of the jaws of each clamp avoid friction between the clamping jaws and the cable when the jaws are open. According to FIG. 3 they have a double action, as do the plungers 22 and 23. The directional control valves 12 and 15 and the lowering brake valve 17, represented diagrammatically in FIG. 1 by hydraulic circuit symbols, are housed adjacently in a common chamber of the housing 4.

In practice, the hydraulically actuated plungers 8, 9 and 22, 23 contain, even when the hydraulic pressure is relieved, residual pressures to a greater or lesser degree according, in each case, to the flow resistances in the supply line, i.e. as a function of line cross sections (hose 18) and line lengths. Also, a continuous pressure may be produced by a hose constriction in the return flow. For safety reasons the embodiment according to FIG. 4 shows double-acting plungers 26, 27 capable of acusing the return stroke of the piston hydraulically, to ensure complete closure of the pairs of clamping jaws.

Figure 5:
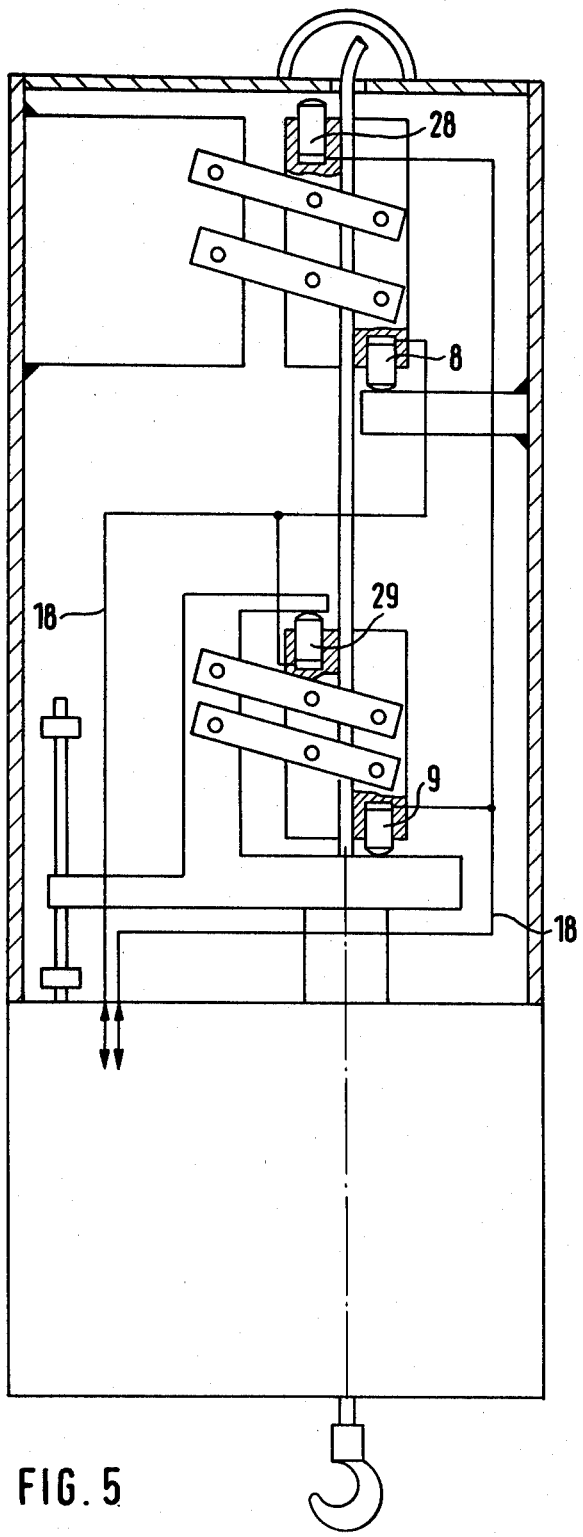
FIG. 5 shows a fourth embodiment of a traction device.

FIG. 5 shows a further embodiment, in which additional closing devices in the form of plungers 28, 29 are provided acting opposite to the plungers 8, 9. These closing plungers 28, 29 force the clamping jaws to close. The plungers 8, 9 and closing plungers 28, 29 shown in FIG. 5 are arranged, for reasons of space, in the clamping jaws. As a general principle, it is also possible to mount them outside the clamping jaws, as in the embodiment in FIG. 1, in which case the closing plungers 28, 29 acting in each case in the direction opposite that of the plungers 8, 9 then act either on the same or on the other clamping jaw of the pair of clamping jaws.

Figure 4:
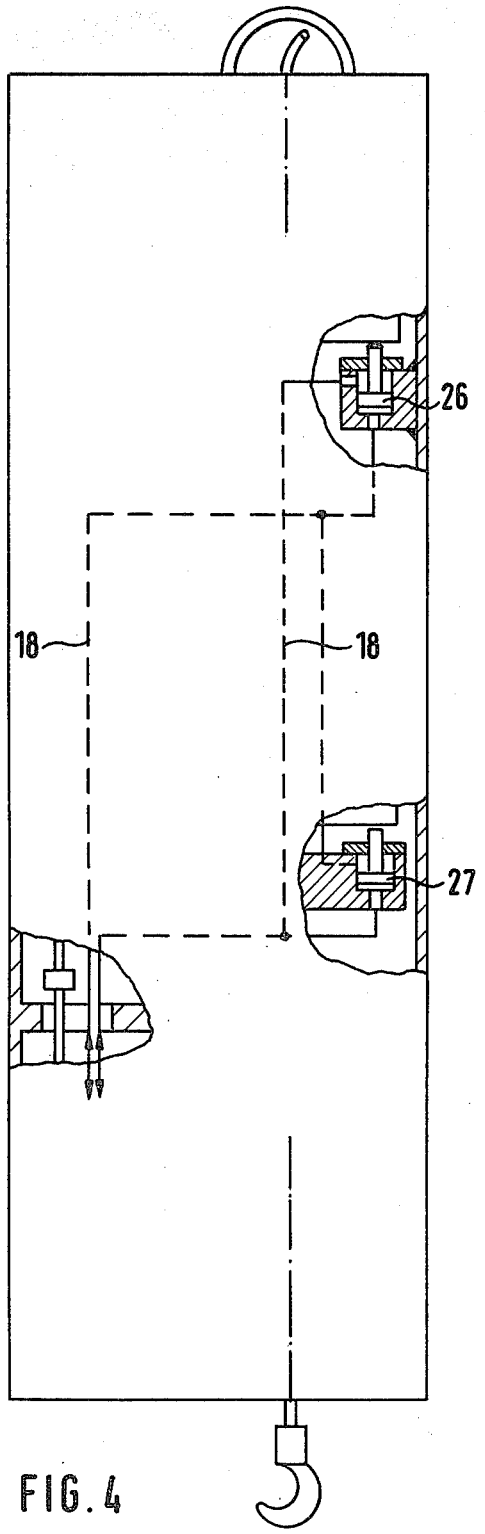
FIG. 4 shows a third embodiment of a traction device.

The hydraulic circuitry for the embodiments of FIGS. 4 and 5 does not require any additional expenditure on control means as it is merely necessary to connect the existing hoses 18 for each of the plungers 8, 9 to the respective closing plunger 28, 29 of the other clamp, so that the plungers 8, 9 move in opposite directions and the closing plungers 28, 29 are moved by the control pressure of the plunger 8, 9 associated with the other clamp.

The arrangement with double-acting plungers 26, 27 according to FIG. 4 or with closing plungers 28, 29 according to FIG. 5 has another important function. A basic requirement is for it to be possible for both clamps to be open at the same time in order to pull the cable through the hoist or to take up free play quickly to tension the cable. Nevertheless, the ability to load both opening plungers together carries the danger that it is possible for the load to be dropped if such simultaneous opening is effected at the wrong time because of incorrect operation while the load is suspended. Therefore, precautions must be taken so that it is only possible to open both pairs of clamping jaws together while there is no load. This is achieved either by providing different piston diameters for the opening and closing plungers and/or different distances from the fulcrum of the clamping jaws to the point of application of the force (FIG. 5). When both plungers are under pressure there should be only a slight net opening force available for overcoming the spring force of the closing springs 19 in the load-free state.

Figure 6:
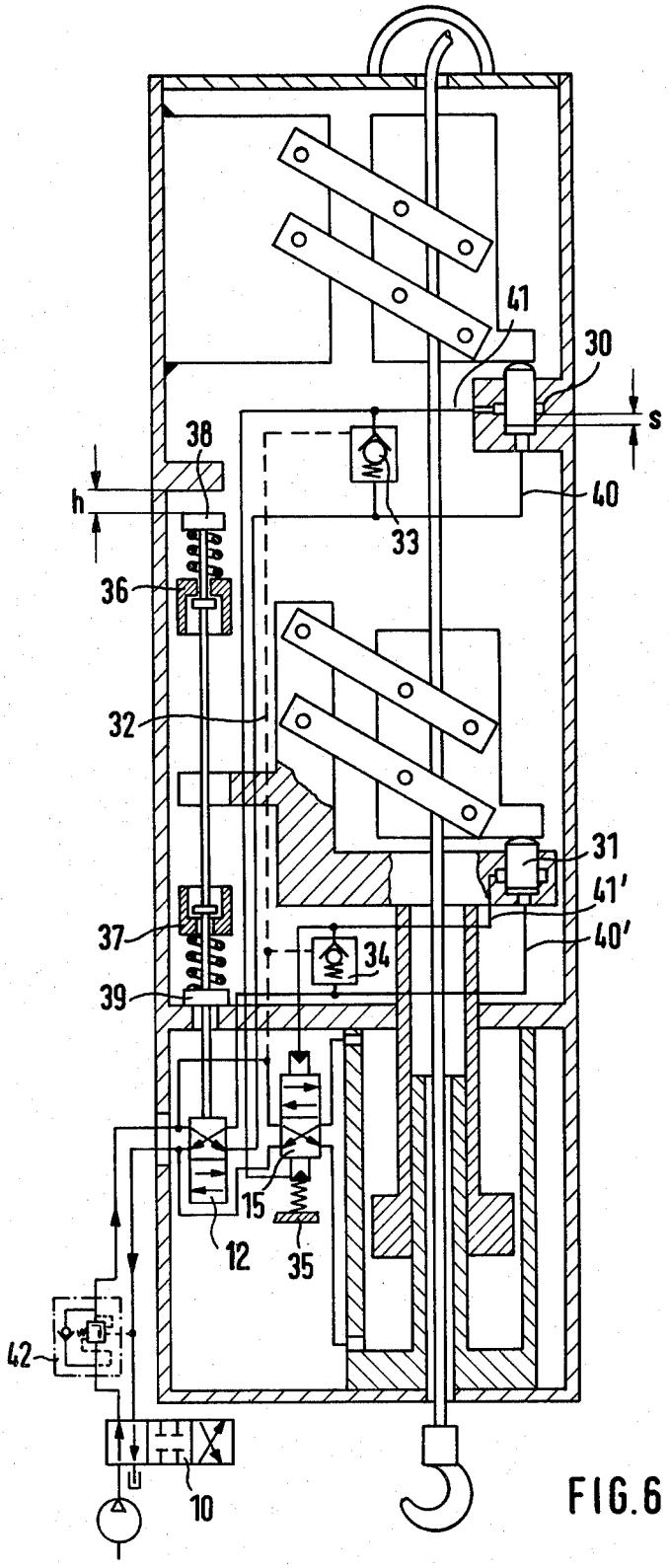
FIG. 6 shows a fifth embodiment of a traction device.

A particularly advantageous embodiment of the cable pull device is represented in FIG. 6.

In order to achieve the necessary control sequence between actuation of the plungers and the reversal of the direction of movement of the piston 2 and to avoid the clamps opening at any time when there is a full load, the opening plungers 30, 31 are designed as two-way directional control valves. As the clamps have to be closed or opened as the load is lowered, before the direction of movement of the piston 2 is reversed, the piston 2 must continue its travel at the upper end of its stroke until the load is taken over by the movable clamp from the stationary clamp. The same applies at the lower end of the piston stroke. The plunger 30 or 31 does not open to initiate the reversal of the direction of movement of the piston 2 via the second directional control valve 15 until after whichever clamping jaws are closed at the time have opened.

On the other hand, when the load is being raised, the direction of movement of the piston 2 must first be changed to allow the clamping jaws to open or close.

In order to achieve this, whenever the "lift" position is selected, pressure medium is supplied via a control line 32 to non-return valves 33 and 34 to open the latter. The non-return valves 33, 34 are provided between the plungers 30, 31 and the valve 12 and, when open, lines 40, 41 and 40', 41' associated with each plunger 30, 31.

In this way whichever plunger 30 or 31 is acting as a closed valve under the load, to prevent inflow of pressure medium, is by-passed through the non-return valve 33 or 34 and the second directional control valve 15 is actuated.

The non-return valves 33, 34 may be integrated with both the two-way directional control valves 12 and 15 in a common block.

When started from the rest position, the "lift" position is ensured by a spring acting on the second directional control valve 15.

As the time sequence between the actuation of the plungers and the reversal of the direction of movement of the piston 2 means that there is a slight overtravel of the piston 2, and as the end positions of the first directional control valve 12 with the stroke S of the plungers 30, 31 is defined by the dogs 38, 39, resilient components in the form of spring-loaded elements 36, 37 are associated with the dogs 38, 39, thereby preventing the control of the first directional control valve 12 being affected by the overtravel of the piston 2.

In addition, in contrast to the embodiment shown in FIG. 1, the embodiment of FIG. 6 has an automatically operated load holding valve 42 in place of the speed control valve 17 in the line through which pressure medium is supplied to the hydraulic valve 12 for lifting during lowering, this is the pressure medium discharge line. This load holding valve 42 is automatically opened from the pump side (pressure side) during lowering. In contrast to this, the speed control valve 17 acts on each stroke of the piston 2 whether the load is being lifted or lowered, which is not always desirable. The load holding valve 42 ensures only that the lowering rate cannot ever exceed that prescribed by the function of the surface ratios to the pump displacement flow in the valve 42.

I claim:

1. A traction device for causing stepwise relative displacement between the device and an elongate member, the device comprising:

(a) a stationary clamp and, (b) a movable clamp which is displaceable by a cylinder and piston unit relative to the stationary clamp in the lengthwise direction of the elongate member, (c) each of said clamps having a pair of closing jaws for engaging the elongate member, (d) a respective pressure-operated jaw opening device being provided for each clamp for opening the jaws of the clamp to release the elongate member, said stationary clamp having a first jaw opening device and said moveable clamp having a second jaw opening device, each of said jaw opening devices having a two way valve therein for blocking the flow of pressure medium when its respective clamp is closed, and permitting the flow of pressure medium when its respective clamp is opened, (e) a first control valve having a first and second state which supplies pressure medium alternately to the first and second jaw opening devices, the state of the first control valve being selected by the movement of the cylinder and piston unit, (f) the stroke direction of the cylinder and piston unit being controlled by a second control valve, said second control valve having a first and a second state with the state of the second control valve also being selected by the pressure medium passing through the two way valves in the jaw opening devices.

2. A traction device as claimed in claim 1, in which the moveable clamp is mounted on a support which is attached to the piston of the cylinder and piston unit, the support cooperating, at the ends of the piston stroke, with dogs to alternate the state of the first control valve between said first and second states.

3. A traction device as claimed in claim 2, in which the opening device for the movable clamp is carried by the support, with the pressure medium being supplied thereto by a hose.

4. A traction device as claimed in claim 1 or 2, in which the jaw opening devices are plungers.

5. A traction device as claimed in claims 1 or 2 or 3, in which all of the jaw opening members are double-acting, and are each operable in one direction to open the respective clamp and in the opposite direction to allow the clamp to close.

6. A traction device as claimed in claim 5, in which operation of the jaw opening device of each clamp in the said opposite direction is controlled by pressure medium supplied to the opening device of the other clamp for operation in the said one direction.

7. A traction device as claimed in claims 1 or 2 or 3, in which the jaw opening devices present different areas to the pressure medium.

8. A traction device as claimed in claims 1 or 2 or 3, in which a respective pressure-operated jaw closing device is provided for each clamp to assist the self-closing action of the clamp.

9. A traction device as claimed in claim 8, in which the jaw closing device of each clamp is controlled by pressure medium supplied to the jaw opening device of the other clamp.

10. A traction device as claimed in claim 6, in which the jaw opening device for each clamp operates on one jaw of the clamp and in which the jaw closing device of that clamp operates on the other jaw.

11. A traction device as claimed in claims 1 or 2 or 3, in which the jaw opening and closing devices are carried by the jaws of the clamps.

12. A traction device as claimed in claim 8, in which, when pressure medium is supplied simultaneously to both the jaw opening device and the jaw closing device of each clamp, the net effect is just sufficient to overcome the self-closing effect of the jaw.

13. A traction device as claimed in claim 1, in which pressure medium from the second control valve is relieved through a non-return valve interconnecting the inlet and the outlet of each two-way valve and wherein the non-return valves are controllable whereby, when the device is applying load to the elongate member, the non-return valves are held open so that pressure medium for operating the second control valve bypasses the respective jaw opening device.

14. A traction device as claimed in claim 13, in which the first and second control valves and the non-return valves are provided in a common unit.

15. A traction device as claimed in claim 1, in which the first control valve is operated by resilient dogs which enable the cylinder and piston unit to continue its stroke after the first control valve has changed over.

16. A traction device as claimed in claim 1, in which the second control valve is resiliently biased into the position corresponding to the application of load to the elongate member.

17. A traction device as claimed in claims 1 or 2 or 3, in which the cylinder and piston unit is single acting in the direction corresponding to the application of load to the elongate member, with return of the cylinder and piston unit being effected by a spring.

18. A traction device as claimed in claims 1 or 2 or 3, in which a speed control valve is provided in the line between the cylinder and the second control valve, the speed control valve being operative during paying out of the elongate member.

19. A traction device as claimed in any one of claims 1, in which an automatic load holding valve is provided in the line between a pressure medium pump and the first control valve for restricting the speed of the elongate member during paying out.

20. A traction device as claimed in claims 1 or 2 or 3, in which the cylinder and piston unit, the clamps, the opening devices and the control valves are accommodated in a housing.

21. A traction device as claimed in claims 1 or 2 or 3, in which each of the stationary clamp and the movable clamp further comprises two clamps mounted on levers which are pivotable about axes passing through the central axis of the cylinder and piston unit, whereby two elongate members can be displaced in tandem through the device.

22. A traction device as claimed in claim 21, in which each of the two movable clamps are pivotally connected to the piston of the cylinder and piston unit, and in which each of the two stationary clamps are mounted on the cylinder on the opposite side of the cylinder and piston unit so as to be nearer the loaded end of the elongate member than the movable clamps.

23. A traction device as claimed in claim 22, in which the stationary clamps are disposed adjacent openings for the elongate member.

24. A traction device as claimed in claims 1 or 2 or 3, which is adapted to raise and lower a loaded elongate member in the form of a cable.

* * * * *